US006115002A

United States Patent [19]

Fischer et al.

[11] Patent Number: 6,115,002

[45] **Date of Patent: *Sep. 5, 2000**

[54] ARRAY OF RADIATING ELEMENTS

[75] Inventors: Henk Fischer, Hengelo; Antonius B. M. Klein Breteler, Neede, both of Netherlands

[73] Assignee: Hollandse Signaalapparaten B.V., Hengelo, Netherlands

[ * ] Notice: This patent issued on a continued prosecution application filed under 37 CFR 1.53(d), and is subject to the twenty year patent term provisions of 35 U.S.C. 154(a)(2).

[21] Appl. No.: 08/860,319

[22] PCT Filed: Dec. 19, 1995

[86] PCT No.: PCT/EP95/05146

§ 371 Date: Jun. 23, 1997

§ 102(e) Date: Jun. 23, 1997

[87] PCT Pub. No.: WO96/20515

PCT Pub. Date: Jul. 4, 1996

[51] Int. Cl.[7] ..... H01Q 13/10

[52] U.S. Cl. ..... 343/770; 343/771; 343/776

[58] Field of Search ..... 343/700 MS, 770, 343/771, 850, 853, 864, 767, 772, 776; H01Q 21/00, 13/10, 21/24

[56] References Cited

U.S. PATENT DOCUMENTS

| | | | |
|---|---|---|---|
| 3,220,007 | 11/1965 | Thourel | 343/771 |
| 3,523,297 | 8/1970 | Fee | 343/771 |
| 3,949,405 | 4/1976 | Roquencourt | 343/771 |
| 4,255,752 | 3/1981 | Noble et al. | 343/771 |
| 5,579,020 | 11/1996 | Kinsey | 343/771 |

*Primary Examiner*—Haissa Philogene
*Assistant Examiner*—Tho Phan
*Attorney, Agent, or Firm*—Oblon, Spivak, McClelland, Maier & Neustadt, P.C.

[57] ABSTRACT

The invention comprises an array of radiating elements (1) to be used as a module in a phased-array radar antenna, the radiating elements consisting of waveguides of rectangular section. The radiating elements are disposed on a common surface (2), which causes the common surface to constitute a side wall of each radiating element. The radiating elements preferably consist of channel sections (3). This consequently yields a rigid construction, while the array can be realised in only a limited number of manufacturing operations.

2 Claims, 3 Drawing Sheets

ARRAY OF RADIATING ELEMENTS

BACKGROUND OF THE INVENTION

The invention relates to an array of radiating elements to be used as a module in a phased array radar antenna, the radiating element being shaped like a waveguide enclosed by walls, which waveguide is substantially rectangular in cross-section.

DESCRIPTION OF THE RELATED ART

Such an array is known from the European patent application EP-A-0.544.378. This patent application describes an antenna module for an active monopulse phased-array system comprising a housing incorporating four radiating elements shaped like waveguides of rectangular section. By suitably stacking the antenna modules, a substantially continuous antenna surface is obtained.

SUMMARY OF THE INVENTION

The array according to the invention has for its object to effect an improvement on said patent application as regards rigidity and distortion. A further object is to provide an array that can be manufactured easier and at relatively lower cost. It is thereto characterised in that the radiating elements are disposed at least substantially in parallel on a common surface and in that this surface constitutes a side wall of each radiating element.

A favourable embodiment of the array is characterised in that the surface constitutes the widest side wall of each radiating element.

If the radiating elements have a non-square section, which generally is the case, these elements can be best mounted on the surface such that the widest wall of these elements faces the surface, as a result of which the surface constitutes the widest wall of each radiating element. Thus, maximum benefit may be derived from the fact that the surface can constitute a side wall of a radiating element, which saves material cost and ensures a rigid construction.

A further favourable embodiment of the array is characterised in that the surface comprises a sheet-shaped element. Such elements are inexpensive and easy to manufacture and moreover offer good attachment possibilities.

A further favourable embodiment of the array is characterised in that at least a part of a radiating element comprises a channel section, which is mounted to the surface by the base parts of both vertical channel section side walls.

This entails a considerable number of advantages. Firstly, channel sections are easy to manufacture and particularly easier than tubular ones. The first type of sections can usually be obtained through a rolling process, whereas the latter are generally obtained on the basis of the far more expensive extrusion process. Channel sections can furthermore be easily secured to a surface by for instance soldering the vertical side walls to it, without causing additional gaps or cavities that could adversely affect the electrical properties of the antenna. Also from a mechanical point of view, the use of channel sections secured to a surface in said manner is to be preferred to the use of tubular sections. By building up the radiating elements from channel sections mounted against the surface, benefit may simultaneously be derived from the fact that the surface can serve as radiating element side wall. The channel section will then have to be mounted to the surface throughout the entire length of the side wall without any air gaps.

It is also possible to provide slots in the surface over the entire length of the channel section to accommodate the vertical side walls of the channel section. This particularly facilitates manufacturing. The channel sections can be fit in the slots and can subsequently be secured by soldering without moving out of position.

A further favourable embodiment of the array is characterised in that, for at least one radiating element, at least in assembled state, a transformer element is provided for feeding, at least substantially reflection-free, radiant energy into said radiating element.

Such a transformer element renders it possible to create, at only extremely low losses, a coupling of radiant energy, generated by an externally-positioned transmitter. In view of the radiating elements being closely spaced, there is hardly or no room left at the side of the radiating element to allow the coupling of radiant energy. It will consequently be required to introduce the radiant energy at the back of the radiating element, for which purpose a transformer element is eminently suitable.

A further favourable embodiment of the array is characterised in that at least one transformer element, at least in assembled state, is integral with the surface.

This entails specific advantages, particularly in the manufacture of the array. The surface, for instance a sheet-shaped surface, can first be provided with the transformer elements, for instance through soldering, after which the radiating elements can be provided in a subsequent operation.

A further exceptionally favourable embodiment of the array is characterised in that the at least one transformer element is manufactured such that it is integral with the surface.

If the positioning of separate transformer elements is a time-consuming operation, which is generally the case, it is recommendable to manufacture the transformer elements such that they are integral with the surface. This saves a substantial number of operations, resulting in an overall reduction of manufacturing costs. When using channel sections as component parts of the radiating elements in combination with transformers, material will have to be removed where the surface exhibits a bulge owing to the presence of a transformer element. The channel section will then as it were cover the transformer element. The combined use of channel sections and transformer elements which are manufactured in one process with the surface particularly offers the advantages of a simple manufacturing process in combination with a light-weight construction having a high degree of rigidity. When using tubular sections, the placement of a transformer element per radiator is considerably more time-consuming than would be the case with channel sections realised in said manner.

A further favourable embodiment of the array is characterised in that the surface has been manufactured in combination with the at least one transformer element in at least one extrusion operation, in the course of which the cross-sectional shape of the at least one transformer element is revealed for the first time.

Based on a sheet-shaped basic section, it is possible to manufacture the sheet-shaped surface pertaining to the array, completely provided with the sheet-shaped basic section of all transformer elements in one extrusion operation. By subsequent mechanical operations, such as milling, drilling or broaching, further details required for the proper functioning of a transformer element can be provided. A further advantage of the surface thus manufactured is that there is a high-strength connection between the transformer elements and the surface is very strong.

A further favourable embodiment of the array is characterised in that a transformer comprises a substantially sheet-shaped conductor, disposed substantially parallel to the surface, which conductor is at a certain point connected with the surface and for the rest encloses a gap-shaped cavity between itself and the surface. Such transformer s possess suitable electrical properties and are pre-eminently suitable to be realized by extrusion, particularly in combination with the surface.

Additionally, the sheet-shaped surface can at one end be provided with a connector for attaching a radiant energy transmission line. This enables each radiating element to be individually controlled via each individual transmission line.

A further favourable embodiment of the array is characterised in that radiation elements are disposed on both sides of the surface. Thus, full benefit can be derived from the fact that a surface has two sides and consequently enables a maximum number of radiating elements to be applied per array. This results in a lighter and more compact construction, since fewer surfaces are required for he complete antenna.

A further favourable embodiment of the array is characterised in that a row of radiation elements positioned on one side of the surface is staggered relatively to a row of radiating elements positioned on the other side of the surface. This yields a more rigid construction at a constant weight and has the added advantage that the beam formation is considerably improved.

A further favourable embodiment of the array is characterised in that a row of radiating elements on one side of the surface is staggered relatively to a row of radiating elements positioned on the other side of the surface over a distance that is substantially equal to half the distance between the centre lines of two radiating elements at one side of the surface. This yields an optimal rigidity and an optimal configuration as regards the beam formation properties.

It is subsequently possible to contiguously position several arrays according to the invention, such that a substantially continuous antenna surface is obtained. A so-called iris plate may be mounted at the front side of this surface, which on the one hand strongly reduces the mutual interference of the various antenna modules and on the other hand greatly improves the rigidity of the construction. The iris plate may consist of a plate having conductive properties, which, at the position of the radiating elements, has been provided with holes that shall preferably be rectangular in shape with a smaller surface than the radiating element apertures. Subsequently, a back plate can be placed at the back which, at the position of the transformers, is provided with connectors, a connector fitting a connector connected to a transformer. The back plate additionally improves the rigidity of the construction.

The array according to the invention will now be explained in greater detail with reference to the following figures, of which

DETAILED DESCRIPTION OF THE INVENTION

An active monopulse phased-array radar is basically composed of a plurality of antenna modules. Each antenna module will be provided with a radiating element and all radiating elements combined will constitute the antenna surface. A well-considered design of the module will be essential to obtain a satisfactory price-performance ratio.

An active monopulse phased-array radar additionally comprises means to which the antenna modules can be mounted. A distribution network shall also be provided for power supply purposes and for RF transmission signals. Furthermore, summation circuits and difference circuits shall be provided for the generation of $\Sigma$, $\Delta B$ and $\Delta E$ output signals.

As it will generally have to be mounted at the top of a ship's mast, a radar antenna shall preferably be light-weight. A light construction will mostly also be more inexpensive than a heavier construction. When using metal waveguides as radiating elements in a phased-array radar antenna, an economical use of materials is consequently essential.

A phased array radar antenna comprises a plurality of radiating elements. It is therefore recommendable to keep the number of components per radiating element as restricted as possible. With a view to manufacturing, it is advisable to aim at a non-complex design of the components required per radiating element. The design of the components shall preferably be such that a large number of components can be realised in a limited number of manufacturing operations.

Also with a view to assembly, a restricted number of components is preferred. The design of the antenna shall enable a large number of components to be mounted in a limited number of assembly operations.

To enable the beam form to be accurately defined, it is of importance that the radiating elements are positioned accurately and at equal relative distances. The positioning of the radiating elements shall additionally be highly independent of external forces. This consequently requires rigid construction.

The array of radiating elements according to the invention to be used as module in a phased array antenna has for its object to meet all said requirements.

Figure 1A:
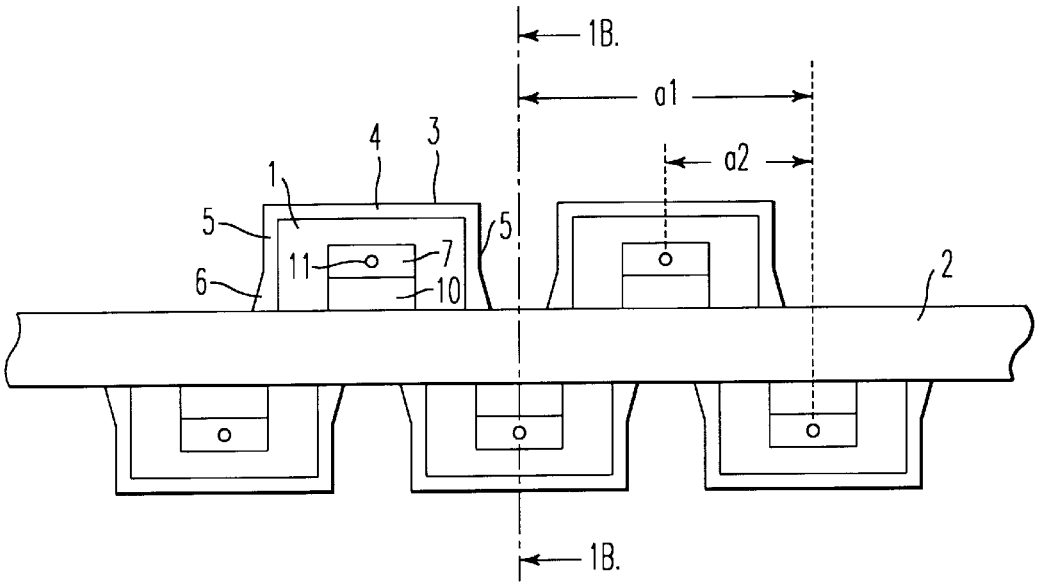
FIG. 1A represents an array of radiating elements according to the invention, comprising a surface designed as a sheet-shaped element on both sides of which the radiating elements are disposed.

FIG. 1A represents the back part of an array of radiating elements 1 according to the invention, comprising a surface designed as a sheet-shaped element 2 to both sides of which the radiating elements are mounted. The back is the side at which radiant energy from a T/R element, not shown here, can be fed into the associated radiating element. The radiating elements consist of channel sections 3, provided with three side walls comprising a web plate 4 and two vertical side walls 5. Via the base part 6, the vertical side walls 5 are connected to the surface 2. In this way, the surface 2 constitutes a fourth side wall of all radiating elements. The radiating elements are disposed at least substantially in parallel on the surface 2. If required, the radiating elements may at the front side be extended beyond the sheet-shaped element 2. By mounting channel-shaped elements to a plate, the construction is less likely to be deformed which enables the beam formation process to be more accurately defined. Benefit can moreover be derived from the fact that the surface 2 is capable of constituting a radiating element side wall. To this end, the surface shall have conducting properties. An additional advantage is that the surface also functions as a mechanical connection between the radiating elements.

The connection between the channel sections and the sheet-shaped element 2 preferably comprises a soldered joint that at least substantially covers the entire length of the base part 6. In the embodiment in question, the vertical side walls 5 are shorter than web plate 4. The width of web plate 4 shall be greater than $\lambda/2$ to prevent the radiating element from entering the cutoff mode. In the illustrated embodiment, the sheet-shaped element 2 thus constitutes the widest side wall per radiating element, although this might also be the narrow side wall. Transformer elements 7 are mounted on surface 2.

Figure 1B:
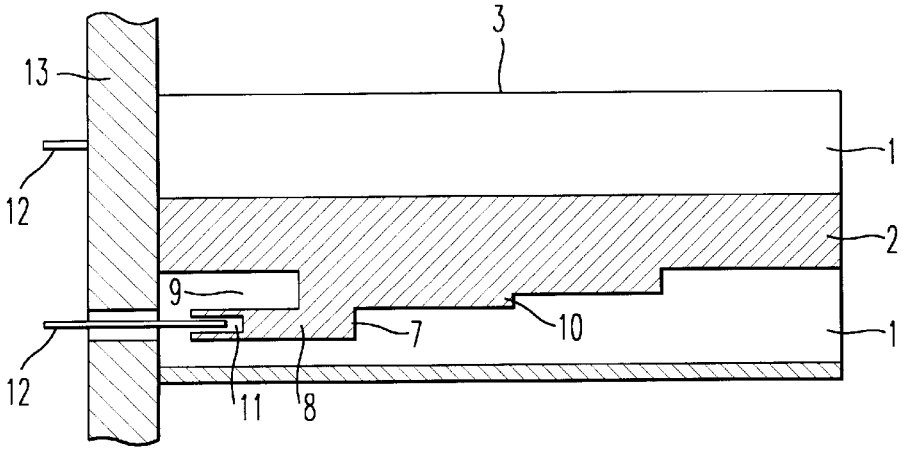
FIG. 1B represents the cross-section A—A, as presented in FIG. 1A.

FIG. 1B represents cross-section A—A as indicated in FIG. 1A. This figure shows that the transformer elements 7 comprise a sheet-shaped part 8, which together with sheet-shaped surface 2 envelops a slot 9. Via intermediate part 10, the sheet-shaped part 8 is electrically and mechanically connected to surface 2. The sheet-shaped part 8 is furthermore provided with a connector shaped as a hole 11 that matches a transmission line shaped as a pin 12, via which high-frequency energy can be applied to the transformer element 7. The transformer element 7 allows for a reflection-free coupling into the radiating element 1 to transmit the radiant energy.

FIG. 1B furthermore shows a back plane 13. The back plane 13 is provided with conducting pins 12, which match the holes 11 in the sheet-shaped parts 8 of the transformer elements and which are on the other side connected to a T/R module. The back plane 13 may on a level with the pins 12 be provided with short protruding parts, not shown in the figure, which accurately fit a radiating element. In this manner, an array of radiating elements can be fixed to the back plane prior to final assembly.

In the illustrated embodiment, the transformer elements 7 are manufactured such that they are integral with the sheet-shaped surface 2. The transformer elements can for instance be realised in an extrusion process which after one operation already reveals the profile of the transformer elements 7. Subsequently, material may be removed in milling operations at the places of attachment of the base parts 6 of the channel sections to the sheet-shaped surface 2. This may be effected such that the intermediate part 10 has the same width as the inside of web plate 4 of a channel section, so that the channel sections can be secured by soldering without moving out of position. It is also possible for the intermediate part 10 to be narrower than the inside of web plate 4 and to provide slots, by for instance milling, in the surface 2 at the location of the base parts 6 of the channel sections into which the channel sections accurately fit. It will be obvious that the options for the pre-fixation of the channel sections are not restricted to those discussed above but also many other possibilities exist, such as the use of detachable spacing jigs. For the sake of clarity, none of the available options have been indicated in the figure. Providing slots is the preferred option as it is a time-saving and effective pre-fixation method.

The transformer elements can also be manufactured by machining the transformer element contours out of a thicker plate.

The channel sections and the sheet-shaped surface combined with the transformers are preferably made of the same material type, for instance aluminum.

In positioning radiating elements on both sides of the sheet-shaped surface, it is advantageous to stagger the radiating elements on one side of the surface with respect to the radiating elements on the other side of the surface over a distance, marked a2 in FIG. 1A, which is substantially equal to half the distance, marked a1 in FIG. 1A, between the centre lines of two radiating elements. This is convenient both with respect to the antenna pattern to be realised and with respect to the mechanical rigidity of the array of radiating elements.

Figure 2:
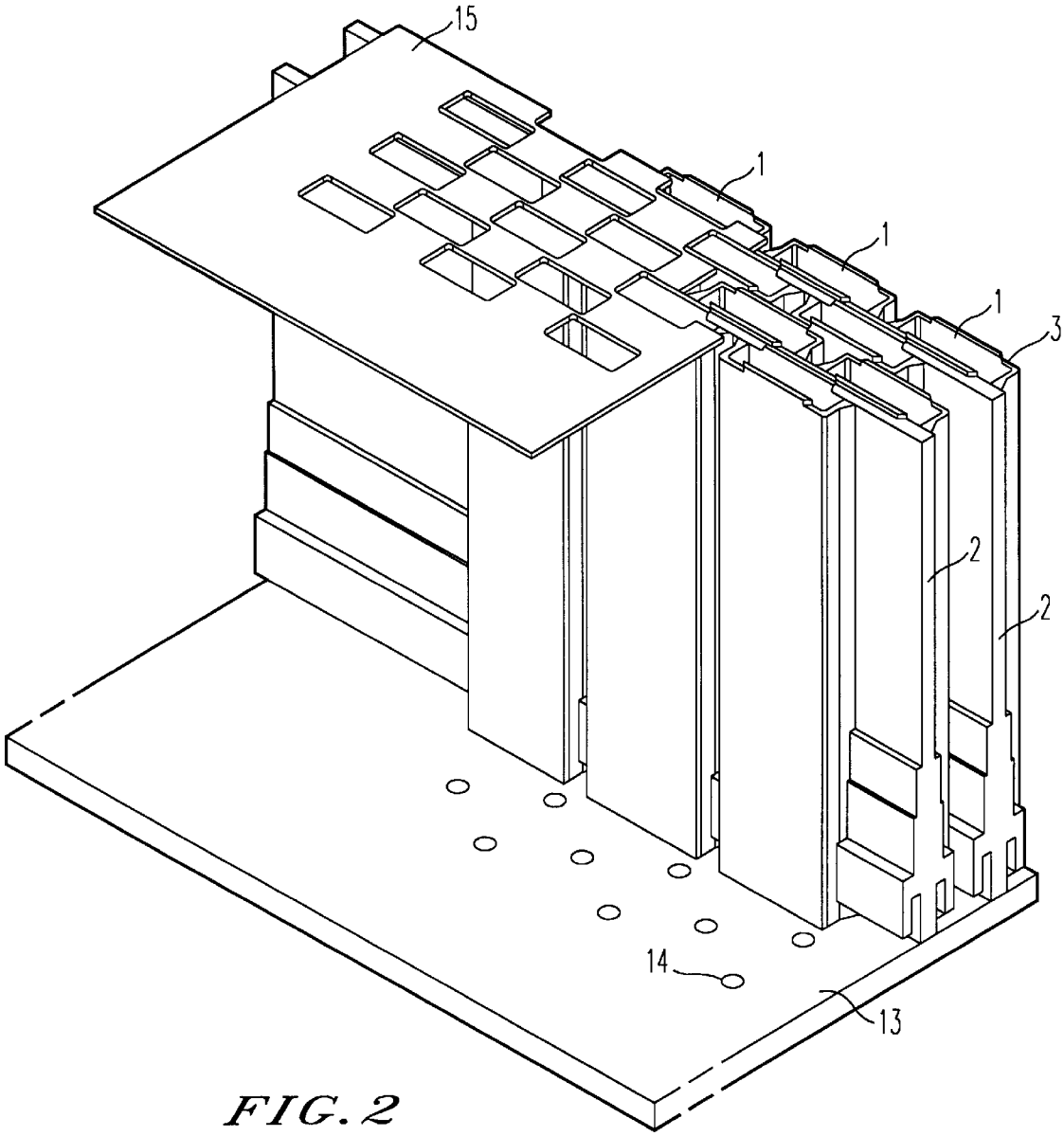
FIG. 2 represents a number of arrays of radiating elements according to the invention, which have been placed side by side and in which an iris plate and a back plate have been provided.

FIG. 2 indicates how a number of array of radiating elements 1 according to the invention can be assembled to obtain an antenna surface extending in two directions. At the back, the arrays are mounted on a back plane 13, which is provided with holes 14 for the feed-through of transmission lines not indicated in the figure, which transmission lines can be connected to their respective transformer elements 7, which are not exposed to view in the figure owing to the presence of the channel sections. The channel sections 3 are disposed on both sides of the sheet-shaped surfaces 2. An iris plate 15 has been mounted at the front of the radiating elements. This plate reduces the mutual interference of the various radiating elements and to a greater extent provides mechanical rigidity. The holes in the iris plate are smaller than the surface at the aperture of a radiating element. The iris plate can be secured by means of a soldered connection.

Figure 3:
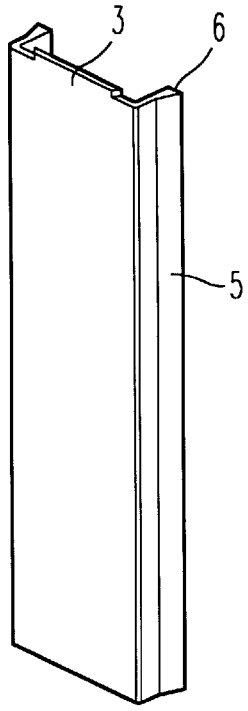
FIG. 3 represents a channel section to be incorporated in an array of radiating elements according to the invention.

FIG. 3 represents a channel section 3, which may serve as radiating element in the array according to the invention. The numbering of the separate parts corresponds to the numbering in the preceding figures. The channel section can for instance be manufactured in a rolling or extrusion process. At the position of the base parts 6 of channel section 3, the side wall is thickened to some extent, which facilitates the mounting of the channel section.

Figure 4:
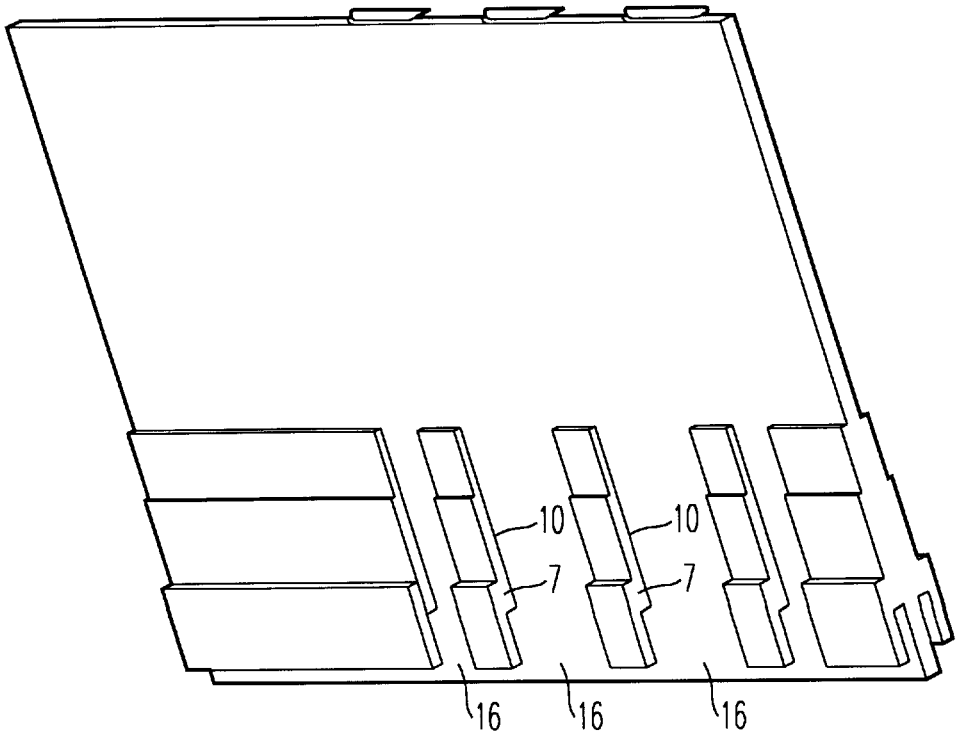
FIG. 4 represents a sheet-shaped element to be incorporated in an array of radiating elements according to the invention.

FIG. 4 represents a surface 2 designed as a sheet-shaped element, which comprises a number of transformers 7. The numbering of the separate parts again corresponds to the numbering in the preceding figures. The transformers 7 are manufactured as integral parts of the sheet-shaped element through extrusion of the sheet-shaped element, which yields an elongated profile of the transformers. At the places of attachment of the base parts 6 of the channel-shaped elements, strips have been removed by milling at a few places 16. If so required, the transformer elements 7 might also be manufactured individually and be subsequently mounted on the sheet-shaped element in for instance a soldering process. This, however, is a more cumbersome and time-consuming procedure than the above-mentioned method. Another solution is to remove material from a thick plate by milling, which yields the transformer elements. This requires more time than extrusion and subsequent milling operations, but is less time-consuming than individual manufacturing and subsequent mounting.

We claim:

1. A linear array of rectangular waveguide radiators configured for use as a module in a two-dimensional phased array antenna, comprising:

a common surface;

radiators disposed substantially parallel to each other on the common surface, each radiator comprises a U-shaped section having legs being connected to the common surface so as to form a waveguide radiator in combination with the common surface, wherein both sides of the common surface being provided with radiators in mutually staggered rows.

2. The linear array of claim 1, further comprising:

a transformer element located in substantially each U-shaped section, wherein the transformer element being integral with the common surface.

* * * * *

UNITED STATES PATENT AND TRADEMARK OFFICE

CERTIFICATE OF CORRECTION

PATENT NO. : 6,115,002
DATED : September 5, 2000
INVENTOR(S) : Henk Fischer, et al.

It is certified that error appears in the above-identified patent and that said Letters Patent is hereby corrected as shown below:

On the title page, the Foregn Application Priority Data has been omitted.
Item [30] should read as follows:

--[30] Foreign Application Priority Data

Dec. 23. 1994 [NL] Netherlands..... 9402195--

Signed and Sealed this

Twelfth Day of June, 2001

*Attest:*

Nicholas P. Godici

*Attesting Officer*

NICHOLAS P. GODICI
*Acting Director of the United States Patent and Trademark Office*